United States Patent [19]

Frystak et al.

[11] Patent Number: 4,484,521

[45] Date of Patent: Nov. 27, 1984

[54] DATE BAND INDEXING MECHANISM FOR ENDORSER

[75] Inventors: Richard Frystak, Park Ridge; Donald R. Friedlund, Round Lake Beach, both of Ill.

[73] Assignee: Bell & Howell Company, Chicago, Ill.

[21] Appl. No.: 470,831

[22] Filed: Feb. 28, 1983

[51] Int. Cl.[3] ..... B41J 1/60

[52] U.S. Cl. ..... 101/111; 101/91

[58] Field of Search ..... 101/111, 105, 110, 106–108, 101/91, 92, 375

[56] References Cited

U.S. PATENT DOCUMENTS

| | | | |
|---|---|---|---|
| 940,186 | 11/1909 | Otteson | 101/111 |
| 1,050,015 | 1/1913 | Gartside | 101/375 |
| 1,067,448 | 7/1913 | Standley | 101/111 X |
| 1,069,868 | 8/1913 | Ellis | 101/111 |
| 1,514,109 | 11/1924 | Stenstrom | 101/375 |
| 1,702,763 | 2/1929 | Clark | 101/91 X |
| 2,773,446 | 12/1956 | Koeber, Jr. | 101/111 X |
| 2,790,386 | 4/1957 | Klaus | 101/375 |
| 2,802,416 | 8/1957 | Karkow, Jr. | 101/91 X |
| 2,807,999 | 10/1957 | Koeber, Jr. | 101/111 X |
| 3,796,152 | 3/1974 | Finke et al. | 101/111 |
| 3,902,413 | 9/1975 | Powell et al. | 101/91 X |
| 4,090,442 | 5/1978 | Yazawa et al. | 101/111 |
| 4,163,422 | 8/1979 | Hamisch Jr. | 101/111 |
| 4,278,023 | 7/1981 | Call et al. | 101/235 |
| 4,333,399 | 6/1982 | Hamisch, Jr. et al. | 101/110 |

*Primary Examiner*—Clifford D. Crowder

*Attorney, Agent, or Firm*—Alan B. Samlan; Neal C. Johnson; Alan H. Haggard

[57] ABSTRACT

An improved mechanism for incrementing characters in a printing device, generally applicable to the field of endorsers. An endless character belt has printing characters on its outer surface, the character belt designed to be incremented to present varied characters. The belt is moved by means of a sprocket wheel having gear teeth. A rod with an upstanding pin engages the sprocket wheel of the character belt to be incremented. By stacking several character belts adjacent to each other, each having its own sprocket wheel, the belts can be incremented separately and apart from each other.

15 Claims, 6 Drawing Figures

31
32
54
56
60
62
64
66
68
70
72
74
76
78
80
82
83
84
86
88

DATE BAND INDEXING MECHANISM FOR ENDORSER

BACKGROUND AND SUMMARY OF THE INVENTION

This invention relates to an endorsing die cylinder and more particularly to an indexing mechanism for incrementing print characters which are carried by the endorser.

A number of various endorsing type mechanisms are available and are generally related to check endorsing apparatus for endorsing bank checks as they are processed to indicate such things as the dates, institution name and number, guaranteed endorsements, and the like. While there have been a number of different types of endorsers available, a problem frequently encountered has been the difficulty of changing the date or other variable indicia. Previously, most devices required the removal of the endorsing die cylinder and the insertion of a probe type tool or pick mechanism which stretched, pushed or pulled the character belt or band for indexing the characters. This was an inconvenient and frequently messy operation as the ink from the endorsing die characters frequently was transferred to the operator's hands.

One such device illustrated in the prior art is disclosed in U.S. Pat. No. 4,278,023 entitled "Drive System for Endorser". This endorser utilizes bands having alpha-numeric characters thereon which are stretched around portions of the die cylinder with the characters to be printed extending through a printing window. In order to change the character presented at the printing window, a probe type device must be inserted to stretch the band to release it from its locking mechanism and then the band must be further stretched and pulled to be incremented.

In U.S. Pat No. 3,085,505 entitled "Endorser Die Drum", a plurality of belts carry the date stamp dies. Again, a separate mechanism must be used to increment the belts, and, although not illustrated, it is assumed that the incrementing is by means of an externally operable hand held probe or pick.

One prior device did attempt to improve the mechanism used to increment the character belts. This is shown in U.S. Pat. No. 2,802,416 entitled "Check Endorsing Apparatus". This device illustrated the use of push-rods with tips at the ends of the rods which slid into engagement with the teeth of a pinion. The pinion was mounted on a shaft which rotated as the pinion rotated. The belt was wrapped around the shaft or a roller on the shaft and was designed to rotate with the rotation of the shaft. However, as the belt was wrapped around the smooth shaft or roller thereon and was not positively engaged or driven, the belt could slip about the shaft and not present the proper character in its proper position for printing. Furthermore, such a device is not applicable to a situation where there are three or more bands adjacent to each other and they are to be incremented individually. The pusher mechanism could not physically accomodate such an arrangement due to its size and the necessity of the pusher mechanism being positioned adjacent to the character belt which it is designed to increment.

Thus, none of the prior art devices have adequately addressed or solved the problem of providing an economical, efficient and accurate means for incrementing the character belt used on endorsing apparatus. The most common devices required the use of an external pick or probe to pull and stretch the belt. Others required the removal of the endorsing die in order to increment the character belts. Still others utilized a pinion and gear assembly with the belts stretched over a rotatable shaft or roller. This, however, did not provide a satisfactory solution as the system could not individually increment several bands adjacent to each other and did not positively lock the character band in one position.

Thus, there is a need to overcome the shortcomings of the prior art devices so that the character belt can be easily and accurately incremented without the messy and unnecessary removal of the endorsing die. It is an object of the present invention to provide an indexing mechanism which can increment individual character belts independently of adjacent belts.

It is also an object to provide an improved indexing mechanism for indexing character belts in multiple sets when desired. A related object is to provide a character belt positioning mechanism which can simultaneously increment several desired adjacent belts in one operation. Another object is to provide an indexing mechanism which positively positions the characters with greater accuracy resulting in better printing quality. Associated with this object is to provide a mechanism which maintains the character belt in a locked position when the characters are not being incremented.

Another object is to provide a character belt indexing mechanism which increments several character belts from one manually operable control device.

The present invention comprises an improved endorsing apparatus for incrementing characters on a plurality of character belts. The device comprises multiple endorsing segments which are contained within the endorsing die. There are two detent blocks placed at opposite ends of the endorsing segments with a sprocket positioned between the detent blocks. The sprocket has both external and internal teeth. The endless character belt has raised characters on its outer circumferential surface for printing. The endless belt encircles both the detent blocks and the sprocket wheel with the external teeth of the sprocket wheel engaging teeth formed on the inside of the endless belt. By rotating the sprocket wheel, movement of the endless belt can be controlled.

The endless belt has identical sets of characters opposite each other so that the same character is presented at each of the detent blocks. This provides for endorsement of documents every 180 degrees of rotation of the endorsing die.

A control rod passes through the central portion of the endorsing die and the sprocket wheels and is slideably retained within the endorsing die. On the control rod is a spring loaded pin which engages the internal teeth of the sprocket wheel. By sliding the control rod, the spring loaded pin engages the desired sprocket wheel to control selected character belts. Thus, by sliding and rotating the control rod, the incrementing of the individually selected character belts is accomplished.

Thus, an improved apparatus for incrementing characters in an endorsing die is provided which permits the quick and easy incrementing of characters on individual character belts without removal of the endorsing die. The character belt is positively controlled by the sprocket wheel which provides for accurate and positive positioning of the character belts.

Many other objects and advantages of the invention will be clear from the following description of the drawings and prefered embodiment.

DESCRIPTION OF THE PREFERRED EMBODIMENT

Figure 1:
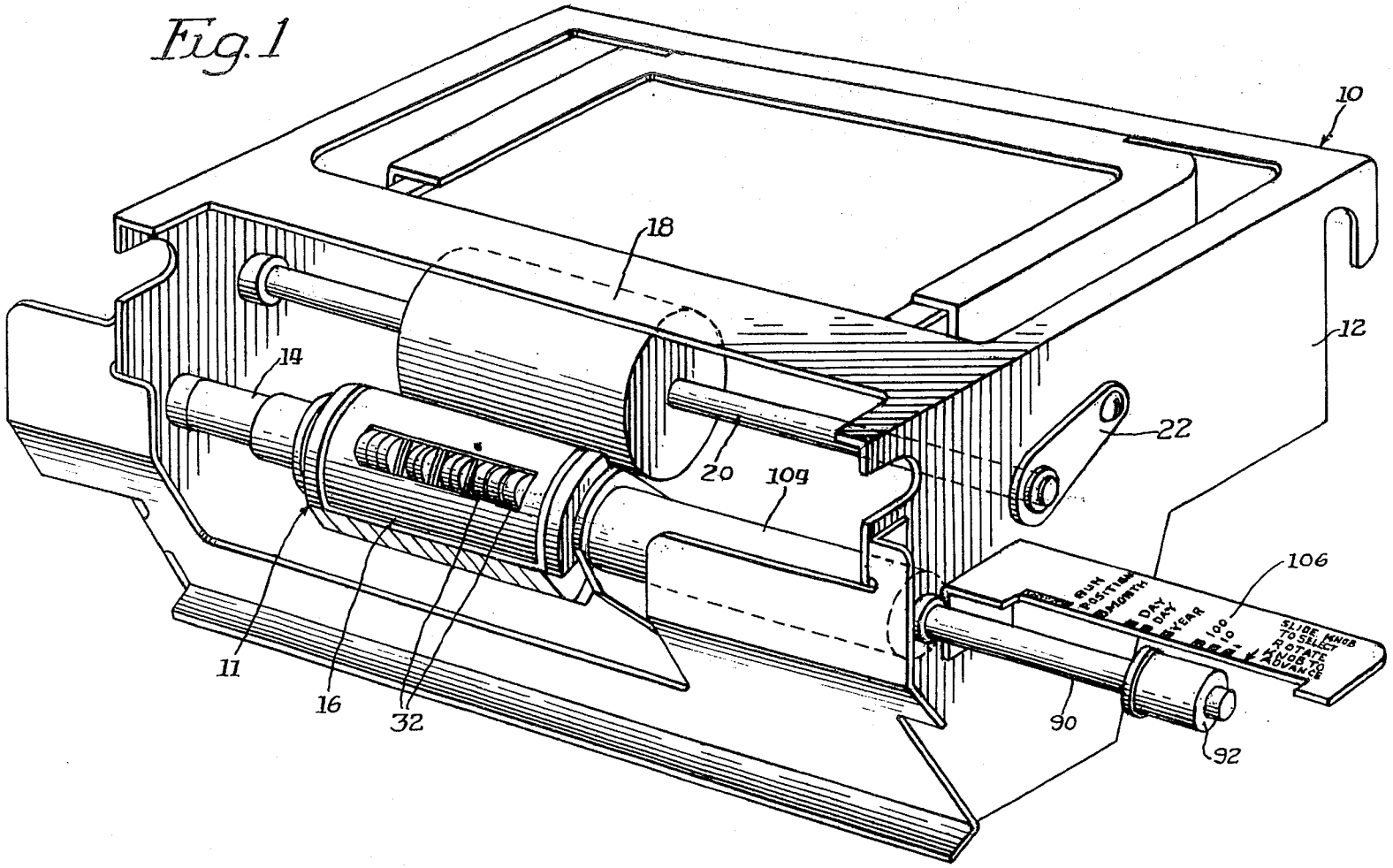
FIG. 1 is a perspective view of an endorser mechanism with the inventive indexing device of the present invention.

Turning first to FIG. 1, there is illustrated a document or check processing piece of equipment 10 on which an endorser 11 can be used. One example of the equipment 10 would be a rotary microfilm camera used to microfilm checks prior to endorsement. The endorser 11 also can be used on other document processing equipment which requires endorsement or printing on the documents which are fed in rapid succession.

The equipment 10 has a frame 12 which supports the endorser 11 and associated drive system. An example of the drive system in which the present invention may be utilized is illustrated in U.S. Pat. No. 4,278,023, entitled "Drive System for Endorser" and incorporated herein by reference. It is necessary that the endorser imprint the documents in a printing area as they are processed through the equipment 10. The endorser is driven through an endorser shaft 14 which is connected to the endorsing drive system as illustrated in U.S. Pat. No. 4,278,023. The drive system for the endorser is not particularly relevant to this invention and thus will only be described briefly below.

The endorser shaft 14 is mounted through bearings to the frame 12. An endorsing die 16 is connected to the endorser shaft 14 and provides for printing the desired characters on the checks or documents. As the endorsing die cylinder 16 rotates, the printing characters contact a transfer roller 18 which transferes ink to the printing characters. The roller 18 rotates on a roller shaft 20 which is connected at its opposite ends to the frame 12. It can be seen that one end of the roller shaft 20 is connected to a pivot member 22 which in turn is connected to the frame 12 and permits the roller shaft 20 to pivot relative to the endorsing die cylinder 16. This compensates for variances in the distance between the endorsing die cylinder and the roller 18.

Figure 2:
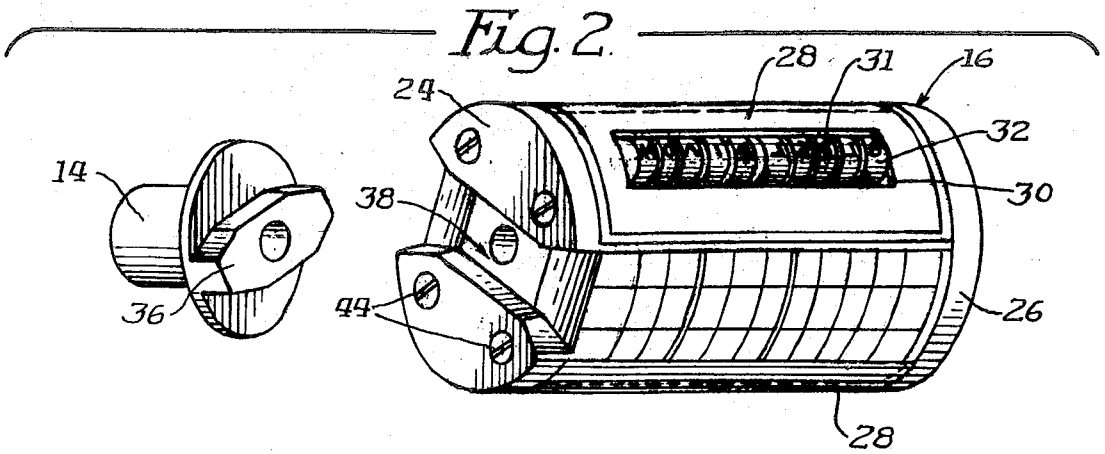
FIG. 2 is a perspective view of an endorsing die and its mating endorsing shaft which drives the endorsing die.
Figure 5:
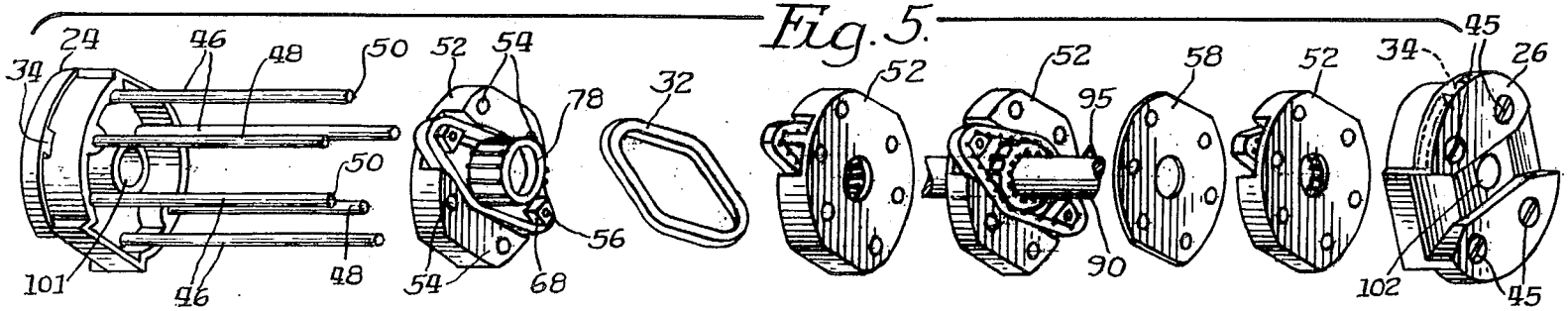
FIG. 5 is an exploded perspective view of an endorsing die having several individual character incrementing segments.

The endorsing die cylinder 16 is illustrated in its entirety in FIGS. 2 and 5. The endorsing die cylinder 16 has a die cylinder end plate 24 at one end and an end cap 26 at the opposite end. These hold the endorsing die cylinder 16 together as will be more fully described below. There are two endorsing printing plates 28 mounted on opposite cylindrical sides of the endorsing die 16. The reason for two endorsing plates 28 is that the illustrated endorser 11 is designed to increment and endorse every 180 degrees of rotation and thus endorses twice for every 360 degrees of rotation. If only one document was to be endorsed for each revolution of the endorsing die 16, then there would only be one endorsing plate 28. This invention is applicable to all endorsers regardless of the number of endorsements made per revolution.

Each of the endorsing plates 28 has a window 30 through which characters 31 on character belts 32 extend. Generally, the endorsing plates 28 have additional printed material in the form of raised letters (not shown), the height of the raised letters being substantially identical to the height of the characters 31 on the characters belts 32. This presents a substantially uniform printing surface height across the entire face of the endorsing plate 28 as it is rotated against the documents to be endorsed.

The plates 28 have end tabs (not illustrated) which are received in channel slots 34 in the die cylinder end plate 24 and end cap 26. This secures and retains the endorsing plates 28 to the end plate 24 and end cap 26. The assembled endorsing die 16 is coupled to the endorser shaft 14 by means of a drive link or bar 36 formed at one end of the endorser shaft 14. This is received by a mating slot 38 on the endorsing die 16.

Four flat head screws 44 pass through the end plate 24 and screw into the ends of four parallel tie rods 46, respectively. The tie rods 46 have internally threaded ends 60. Integral with the end plate 24 are two guide pins 48 which are diametrically opposite each other. The tie rods 46 and guide pins 48 are all parallel to each other and perpendicular to the die cylinder end plate 24.

Assembly of the endorsing die 16 is best seen in the exploded view of FIG. 5. The die cylinder end plate 24 with its protruding tie rods 46 and guide pins 48 receive a first endorsing segment 52 by passing the tie rods 46 and guide pins 48 through respective sets of rod holes 54 and guide pin holes 56 defined through the endorsing segment 52. The first endorsing segment 52 is moved down the rods until it engages the die cylinder end plate 24. Several endorsing segments 52 are successively slid onto the tie rods and guide pins to form a stack, the number depending upon the number of characters to be printed. The endorsing segments 52 can be separated by spacer discs 58 depending upon the spacing required between the printing characters. After all of the endorsing segments 52 are placed on the tie rods 46 and guide pins 48, the end cap 26 is placed against the last positioned endorsing segment 52. Four flat head screws 45 pass through the end cap 26 and are threadedly received in the ends 50 of the tie rods 46 to secure the endorsing die 16 into an assembled unit.

Figures 3, 4:
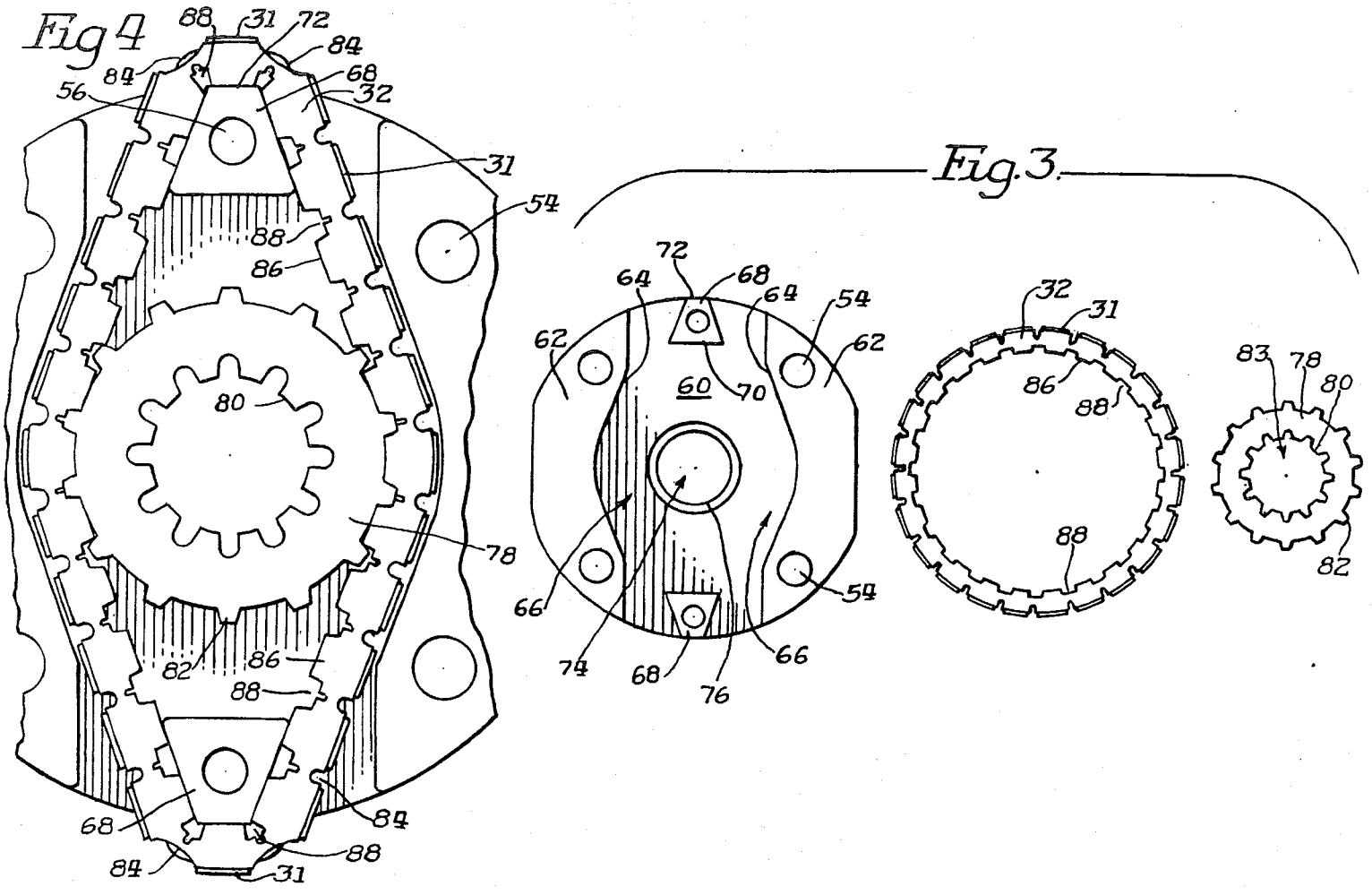
FIG. 3 is an unassembled view of the components of an individual endorsing segment.
FIG. 4 is an assembled view of the device illustrated in FIG. 3, with portions removed.

The various components within each endorsing segment 52 are clearly illustrated in FIGS. 3 and 4. As seen in FIG. 3, endorsing segment 52 has a bottom wall 60 which has two upstanding ears 62 diametrically opposite each other. The ears 62 form side walls 64 which define one side of a channel 66. Centrally placed between the ears 62, and diametrically opposite each other are two detent blocks 68. The detent blocks 68 help to define the path of the character belt 32 and form a platen or support for the character belt 32 during printing. The detent blocks 68 are shaped like a trapezoid with a base 70 nearest the center of the endorsing segment 52 and a smaller top surface 72 near the perimeter of the endorsing segment 52. The guide pin holes 56 pass through the detent blocks 68 with the axis of the guide pin holes 56 perpendicular to the bottom wall 60.

The guide pins 48 pass through the pin holes 56 to give strength and support to the detent blocks 68. An opening 74 is defined through the center of the segment 52. An annular collar 76 is secured on the wall 60 co-axially with the opening 74.

Another component to be assembled on the segment 52 is a sprocket wheel 78. This has an internal circumferencial shoulder groove (not illustrated) which seats on the collor 76 so that the wheel 78 is free to rotate but not free to slide axially on the collar 76. The sprocket wheel 78 has both internal teeth 80 and external teeth 82. The wheel 78 includes a central passage 83 which is in alignment with the opening 74 when the sprocket wheel 78 is seated on the collar 76. The channels 66 are formed between and defined by the side wall 64 and the external teeth 82. It will be seen in FIG. 4 that the belt 32 is disposed within the channels 66 and about the blocks 68 and drive wheel 78. The outer teeth 82 of the wheel 78 are in engagement with the grooves 88 of the belt 32 on diametrically opposite portions of the wheel. Accordingly, firm driving engagement is effected there between such that the belt 32 is revolved in its path in response to the rotation of the wheel 78.

As mentioned above, the character belt 32 includes a plurality of print characters 31 on the outer surface of the belt 32. The characters 31 are separated from each other by relief grooves 84 defined in the outer periphery of the belt. The internal surface of the belt 32 has internal teeth 86 separated by grooves 88.

The dimensions of the external teeth 82 on the sprocket wheel 78 and the dimension of the openings 88 are such that when the sprocket wheel 78 is placed on the endorsing segment 52, and the character belt 32 is placed around it as illustrated in FIG. 4, the external teeth 82 will mesh with and engage the openings 88. It will be apparent that the detent blocks 68 and wheel 78 can be dimensioned axially so as to receive two or more belts, side-by-side if desired.

The character belt 32 is manufactured of an elastic or rubberlike material with the circumference dimensioned such that the belt 32 will be snuggly received around the sprocket wheel 78 and the detent blocks 68 as it encompasses all of these elements. The top surface 72 of the detent block 68 is also dimensioned such that the distances between the grooves 88 allow the flattened internal teeth 86 to rest upon the top surface 72. The top surface 72 thus provides a backing support for the respective character 31 during printing. The relief grooves 84 allow the outer circumference of the belt 32 to be stretched around the detent block 68 and accomondate the bending and stretching of the belt. Additionally, the grooves 84 allow only the character 31 to be presented in the printing area without interference of adjacent belt material to thus provide clean, clear printing of the character.

The grooves 88 are compressed at the corners of the top surface 72 where the belt passes around the detent block 68. This aids in allowing the belt 32 to rest against the top surface 72 in a flat plane. Furthermore, as the character belt 32 is rotated around the detent blocks 68, adjacent grooves 88 engage the corners of the top surface 72 and provide a reference point for stopping rotation of the character belt 32 when the desired character 31 is in the print position.

Figure 6:
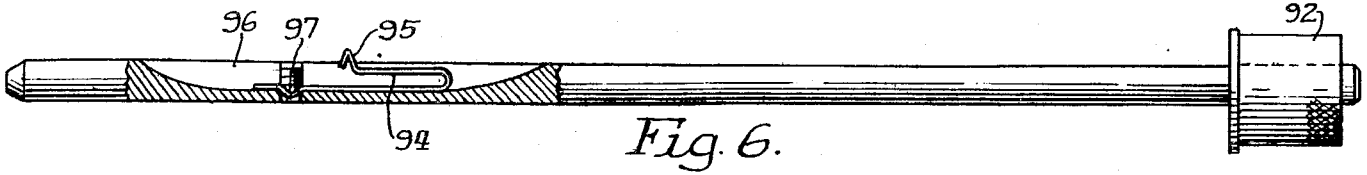
FIG. 6 is a side view with portions removed of the control rod used to increment the individual character belts.

With the endorsing die cylinder 16 properly positioned and coupled to the endorser shaft 14 (as illustrated in FIG. 1), each of the character belts 32 can be moved to position a desired character at the window 30. This is accomplished by the use of a control rod 90 shown in detail in FIG. 6. The control rod 90 includes an operating knob 92 at one end. As shown in the cross-section portion of FIG. 6, a generally u-shaped pin 94 is received within a recess 96 defined in the rod 90 and is secured in place by a set screw 97. The pin 94 includes a tip 95 which projects outwardly beyond the surface of the rod 90. The pin 94 is flexible, resilient and spring-like such that the tip 95 can shift up and down as viewed in FIG. 6.

It will be seen in FIG. 5 that the end members 24 and 26 of the die cylinder 16 have respective central openings 101 and 102 which are aligned with the respective openings 74 in the endorsing segments when the die cylinder is assembled. The rod 90 is insertable through these aligned openings as will be described.

As shown in FIG. 1, the assembled die cylinder 16 is mounted on the shaft 14. A hollow shaft 104 is mounted within the main frame 12 in alignment with the opposite end of the die cylinder 16. The rod 90 is inserted through the hollow shaft 104 and into the die cylinder when it is desired to change the characters to be printed. The rod 90 is moved to engage the tip 95 with the internal teeth 80 of a sprocket wheel 78 associated with a desired one of the character belts 32. The spring-like structure of the pin 94 provides a tactile indication to the operator that the tip 95 is in engagement with the teeth 80. The rod 90 is then rotated to move the belt 32 to display a desired character in the window 30. The above described interrelationship of the belt 32 fitting on the top surface of the detent blocks 68, tends to seat a desired character in proper position for printing.

As shown in FIG. 1, the machine may include an index plate 106 mounted adjacent to the rod 90. Indicia such as the month, day, year etc., is marked on the plate 106 commensurate with the data on the corresponding character belts. The operating knob 92 can be moved adjacent to the desired indicated data to position the tip 95 of the rod in engagement with the correct belt cylinder. After each belt has been moved to display the desired characters for printing, the rod 90 can be moved all the way to the left as viewed in FIG. 1 to dispose the tip 95 out of engagement with the sprocket wheels 78. The machine can then be operated for printing in the normal manner.

The character belt 32 is designed such that the characters 31 on opposite sides of the belt are identical. Thus, for each 180 degrees of rotation of the endorsing die cylinder 16, a document is imprinted with identical indicia as the previous document printed with the opposite side of the endorsing cylinder.

Thus, it can be seen that by using this modular technique, several endorsing segments can be built upon each other to produce an endorsing die cylinder which will print the required indicia. The character belt is engaged by the sprocket wheel at two separate locations which aid in driving the character belt and yet lock the belt in the desired position. Furthermore, the character belt is wrapped around the detent blocks at an oblique angle to provide accurate and stable positioning of the character belt in the proper printing position.

Thus, it is apparent that there has been provided, in accordance with the invention, an improved indexing mechanism for incrementing characters on an endorser that fully satisfies the objects, aims, and advantages set forth above. While the invention has been described in conjunction with a specific embodiment thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed is:

1. In a printing device having a plurality of individually stackable modular endorsing segments stacked adjacent each other and secured by securing means in a locked relationship relative to each other, an improved mechanism for incrementing the printing characters on each endorsing segment comprising:

an endless character belt mounted on each said segment and having the printing characters to be incremented on its outer circumferential surface and inner gear teeth on its inner circumferential surface, the inner gear teeth separated by grooves recessed in the belt, the characters on the belt located between adjacent grooves, sprocket means mounted on each segment and having external teeth which engage the inner gear teeth of the character belt, drive means to rotate the sprocket means, a first detent block on each segment spaced apart from the sprocket means, a second detent block on each segment spaced apart from the sprocket means and on the diametrically opposite side of the sprocket means and of the segment from the first detent block, the detent blocks having a top surface and two side surfaces, the top and side surfaces intersecting at two corners, the length of the top surface being defined by the distance between the two corners, the grooves in the belt separated by a distance equal to the length of the top surface, with the grooves causing the belt to seat on the corners, the character belt encircling and in contact with the first and the second detent blocks and the sprocket means, whereby rotation of the sprocket means by the drive means causes the character belt to rotate about the sprocket means and detent block thereby presenting different printing characters at the detent block, each sprocket means adapted to be rotated independently of the sprocket means on adjacent endorsing segments.

2. The mechanism of claim 1, wherein the external teeth of the sprocket means engage the inner teeth of the character belt at two separate locations opposite each other on the sprocket means.

3. The mechanism of claim 2, wherein the character belt is comprised of two identical sets of printing characters opposite each other on the belt, with the identical printing character being presented simultaneously at each detent block.

4. The mechanism of claim 1, wherein the sprocket means and detent block are dimensioned to receive more than one character belt on a single sprocket means and detent block, with all character belts on a single sprocket rotating simultaneously and in unison with one another.

5. The mechanism of claim 1, and further comprising spacer means interposed between selected endorsing segments to space the printing characters, the spacer means secured in a locked relationship relative to adjacent endorsing segments.

6. The mechanism of claim 1, wherein the securing means comprises two end pieces, one of the end pieces placed at each end of the stack of modular endorsing segments, and securing rods fastened to the end pieces and passing through each of the endorsing segments.

7. The mechanism of claim 1, wherein the drive means includes gear teeth on the sprocket means engagable by a tool to drive the character belt.

8. The mechanism of claim 7, wherein the tool includes an upstanding pin mounted on a rod, the rod being slidable so that the pin can be slid into engagement with the gear teeth, and the rod being rotatable so that the operator can rotate the character belt.

9. The mechanism of claim 8, and further comprising two or more modular endorsing segments secured by securing means relative to each other, each having mounted on it first detent blocks and sprocket means, and a central passageway in each sprocket means in alignment with adjacent sprocket means, the rod passing through the central passageways and slidable along the axis of the passageway whereby the upstanding pin can selectively engage the gear teeth of the desired sprocket means.

10. An improved mechanism comprising:

at least two individually stackable modular endorsing segments stacked adjacent each other and secured by securing means in a locked relationship relative to each other, each segment comprising:

an endless character belt having printing characters on its outer circumferential surface and inner gear teeth on its inner circumferential surface, sprocket means having a central passageway with internal gear teeth surrounding the central passageway and external teeth defining the outer surface of the sprocket means which engage the inner gear teeth of the character belt, a first detent block spaced apart from the sprocket means, a second detent block spaced apart from the sprocket means and on the opposite side of the sprocket means than the first detent block, the character belt encircling and in contact with the first detent block and the external teeth of the sprocket means, and an opening in alignment with the central passageway of the sprocket, the sprocket means and detent blocks on the first modular segment having an axial width substantially equal to the width of one character on the character belt, and the sprocket means and detent blocks on the second modular segment having a width greater than the width of one character on the character belt, the opening and central passageway of each of the endorsing segments in alignment with the other segments, a rotatable rod with means thereon to engage the internal gear teeth of the sprocket means, the rod slidably received within the openings and central passageways, whereby the means on the rod to engage the internal gear teeth can be repositioned within each sprocket means to simultaneously rotate all associated character belts on the given sprocket means, each sprocket means adapted to be rotated independently of the sprocket means on adjacent endorsing segments.

11. The mechanism of claim 10, wherein the external teeth of the sprocket means engage the inner teeth of the character belt at two separate locations opposite each other on the sprocket means to push the belt in one direction on one side of the sprocket means while pulling the belt in an opposite direction on the opposite side of the sprocket means.

12. The mechanism of claim 10, wherein the character belt is comprised of two identical sets of printing characters diametrically opposite each other on the belt, with the identical printing character being presented simultaneously at each detent block.

13. The mechanism of claim 10, and further comprising spacer means interposed between selected endorsing segments to space the character belts, the spacer means secured in a locked relationship relative to adjacent endorsing segments.

14. The mechanism of claim 10, and further comprising securing means to secure the endorsing segments to each other in a locked relationship, the securing means comprising two end pieces, with one of the end pieces placed at each end of the plurality of endorsing segments, and securing rods fastened to the end pieces and passing through each of the endorsing segments.

15. The mechanism of claim 10, wherein the inner gear teeth on the character belt engage the detent block to seat and accurately position the character belt against the detent block for printing.

* * * * *